United States Patent [19]

Vanier

[11] Patent Number: 4,782,041

[45] Date of Patent: Nov. 1, 1988

[54] SLIPPING LAYER CONTAINING AMINO-MODIFIED SILOXANE AND ANOTHER POLYSILOXANE FOR DYE-DONOR ELEMENT USED IN THERMAL DYE TRANSFER

[75] Inventor: Noel R. Vanier, Rochester, N.Y.

[73] Assignee: Eastman Kodak Company, Rochester, N.Y.

[21] Appl. No.: 173,326

[22] Filed: Mar. 25, 1988

[51] Int. Cl.[4] ..... B41M 5/035; B41M 5/26

[52] U.S. Cl. ..... 503/227; 8/471; 427/256; 428/195; 428/327; 428/341; 428/447; 428/913; 428/914

[58] Field of Search ..... 8/471; 427/256; 428/195, 323, 327, 341, 447, 480, 913, 914; 503/227

[56] References Cited

FOREIGN PATENT DOCUMENTS 0138483 4/1985 European Pat. Off. ..... 503/227

0163145 12/1985 European Pat. Off. ..... 503/227

*Primary Examiner*—Bruce H. Hess

*Attorney, Agent, or Firm*—Harold E. Cole

[57] ABSTRACT

A dye-donor element for thermal dye transfer comprising a support having on one side thereof a dye layer and on the other side a slipping layer comprising a lubricating material in a polymeric binder, the lubricating material comprising a linear or branched aminoalkyl-terminated poly(dialkyl, diaryl or alkylaryl siloxane) such as an aminopropyldimethyl-terminated polydimethylsiloxane or a T-structure polydimethylsiloxane with an aminoalkyl functionality at the branchpoint, and another polysiloxane, other than said aminoalkyl-terminated polysiloxane, which comprises a copolymer of a polyalkylene oxide and methyl alkylsiloxane wherein the alkyl group has more than one carbon atom.

20 Claims, No Drawings

SLIPPING LAYER CONTAINING AMINO-MODIFIED SILOXANE AND ANOTHER POLYSILOXANE FOR DYE-DONOR ELEMENT USED IN THERMAL DYE TRANSFER

This invention relates to dye-donor elements used in thermal dye transfer, and more particularly to the use of a certain slipping layer, comprising a lubricating material in a polymeric binder, on the back side thereof to prevent various printing defects and tearing of the donor element during the printing operation. The lubricating material comprises a mixture of polysiloxanes.

In recent years, thermal transfer systems have been developed to obtain prints from pictures which have been generated electronically from a color video camera. According to one way of obtaining such prints, an electronic picture is first subjected to color separation by color filters. The respective color-separated images are then converted into electrical signals. These signals are then operated on to produce cyan, magenta and yellow electrical signals. These signals are then transmitted to a thermal printer. To obtain the print, a cyan, magenta or yellow dye-donor element is placed face-to-face with a dye-receiving element. The two are then inserted between a thermal printing head and a platen roller. A line-type thermal printing head is used to apply heat from the back of the dye-donor sheet. The thermal printing head has many heating elements and is heated up sequentially in response to the cyan, magenta and yellow signals. The process is then repeated for the other two colors. A color hard copy is thus obtained which corresponds to the original picture viewed on a screen. Further details of this process and an apparatus for carrying it out are contained in U.S. Pat. No. 4,621,271 by Brownstein entitled "Apparatus and Method For Controlling A Thermal Printer Apparatus," issued Nov. 4, 1986, the disclosure of which is hereby incorporated by reference.

A problem has existed with the use of dye-donor elements for thermal dye-transfer printing because a thin support is required in order to provide effective heat transfer. For example, when a thin polyester film is employed, it softens when heated during the printing operation and then sticks to the thermal printing head. This causes intermittent rather than continous transport across the thermal head. The dye transferred thus does not appear as a uniform area, but rather as a series of alternating light and dark bands (chatter marks). Another defect called "smiles", which are crescent shaped low density areas, is produced in the receiving element by stretch-induced folds in the dye-donor. Another defect is produced in the receiving element when abraded or melted debris from the back of the dye-donor builds up on the thermal head and causes steaks parallel to the travel direction and extending over the entire image area. In extreme cases, sufficient friction is often created to tear the dye-donor element during printing. It would be desirable to eliminate such problems in order to have a commercially acceptable system.

European Patent Applications 163,145 and 138,483 relate to dye-donor elements having a slipping layer on the back side thereof comprising a lubricant in a resin binder along with particulate material. A large list of lubricating materials is disclosed including various modified silicone oils such as an amino-modified silicone oil. No specific examples are disclosed, however.

U.S. application Ser. No. 062,796 of Vanier and Evans, filed June 16, 1987, relates to the use of particular amino-modified silicone materials for use as a slipping layer in thermal dye transfer systems. U.S. application Ser. No. 076,433 of Henzel, Lum and Vanier, filed July 21, 1987, relates to the use of silicone and phosphate ester materials for use as a slipping layer in thermal dye transfer systems. While these slipping layers have good properties, it would be desirable to provide a slipping layer which reduces the force required for passage through a thermal print head.

Accordingly, this invention relates to a dye-donor element for thermal dye transfer comprising a support having on one side thereof a dye layer and on the other side a slipping layer comprising a lubricating material in a polymeric binder, the lubricating material comprising a linear or branched aminoalkyl-terminated poly(dialkyl, diaryl or alkylaryl siloxane), and wherein the slipping layer also comprises another polysiloxane, other than the aminoalkyl-terminated polysiloxane, comprising a copolymer of a polyalkylene oxide and a methyl alkylsiloxane wherein the alkyl group has more than one carbon atom.

Any aminoalkyl-terminated polysiloxane can be employed in the slipping layer of the invention providing it contains units of a linear or branched aminoalkyl-terminated poly(dialkyl, diaryl or alkylaryl siloxane). In a preferred embodiment of the invention, the aminoalkyl-terminated polysiloxane is an aminopropyldimethyl-terminated polydimethylsiloxane such as one having the formula:

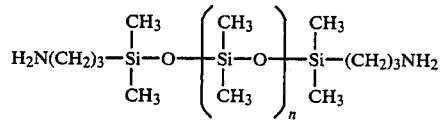

wherein n is from about 10 to about 2000. This material is supplied commercially from Petrarch Systems, Inc. Bartram Rd. Bristol, Pa. 19007 as PS513 ®.

In another preferred embodiment of the invention, the aminoalkyl-terminated polysiloxane is a T-structure polydimethylsiloxane with an aminoalkyl functionality at the branchpoint, such as one having the formula

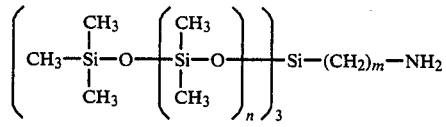

wherein m is from about 1 to about 10 and n is from about 10 to about 1000. This material is supplied commercially from Petrarch Systems, Inc. as PS054 ®.

As noted above, the second polysiloxane which is employed in the slipping layer of the invention is a copolymer of a polyalkylene oxide and a methyl alkylsiloxane wherein the alkyl group has more than one carbon atom, and the second polysiloxane is not an aminoalkyl-terminated polysiloxane. In a preferred embodiment of the invention, the alkyl group of the alkylsiloxane has about 8 carbon atoms and the polyalkylene of the polyalkylene oxide is polypropylene. This material is supplied commercially by BYK Chemie, USA, as BYK-320 ®.

The polysiloxanes may be present in the slipping layer of the invention in any amount which is effective for the intended purpose. In a preferred embodiment of the invention, each polysiloxane independently is present in an amount of from about 0.0005 to about 0.03 $g/m^2$, representing approximately 0.2 to 12% of the binder weight, and the polymeric binder is present in an amount of about 10 to about 99.5% of the total layer coverage.

It was found that using the two polysiloxane compounds as described above in accordance with the invention gave improved performance beyond that obtained using equivalent quantities of each material alone.

In another preferred embodiment of the invention, the slipping layer may also have organic lubricating particles dispersed therein. Any such particles may be used as long as they are organic and have the desired property of being lubricious in nature. Such materials would include particles having long linear hydrocarbon chains (greater than 8 carbon atoms), polyolefins, long-chain amides, acids, alcohols, amines, phosphates, etc.; polyfluorocarbons, polyalkyl(aryl)siloxanes, etc. For example, there may be employed:

(1) micronized polyethylene particles, such as MPP-620XF ® from Micro Powders Inc., average particle size 2 μm and melting point of 116° C.;
(2) micronized polytetrafluoroethylene fluorocarbon powder, such as Fluo HT ® from Micro Powders Inc. having a particle size of 2–4 μm;
(3) Polyfluo 190 ® (Micro Powders Inc.) polytetrafluoroethylene/polyethylene composite particles;
(4) Whitcon TL 120 ® (LNP Engineering) fluorinated ethylene propylene;
(5) micronized synthetic waxes such as S-400 N1 ® (Shamrock Chemical Corp.) or
(6) micronized waxes such as stearyl stearamide or ethylene bis stearamide.

These particles are described more fully in copending Application Ser. No. 07/173,345, filed of even date herewith, entitled "Slipping Layer Containing Amino-Modified Siloxane and Organic Lubricating Particles for Dye-Donor Element Used in Thermal Dye Transfer", by Vanier.

The lubricating particles may be employed in any concentration which is effective for the intended purpose. In general, good results have been obtained at a concentration of from about 0.005 $g/m^2$ to about 1.0 $g/m^2$.

Any polymeric binder can be used in the slipping layer of the invention provided it has the desired effect. In a preferred embodiment, thermoplastic binders are employed. Examples of such materials include, for example, poly(styrene-co-acrylonitrile) (70/30 wt. ratio); poly(vinyl alcohol-co-butyral) (available commercially as Butvar 76 ® by Dow Chemical Co.; poly(vinyl alcohol-co-acetal); poly(vinyl alcohol-co-benzal); polystyrene; poly(vinyl acetate); cellulose acetate butyrate; cellulose acetate propionate; cellulose acetate; ethyl cellulose; bisphenol-A polycarbonate resins; cellulose triacetate; poly(methylmethacrylate); copolymers of methyl methacrylate; poly(styrene-co-butadiene); and a lightly branched ether modified poly(cyclohexylene-cyclohexanedicarboxylate):

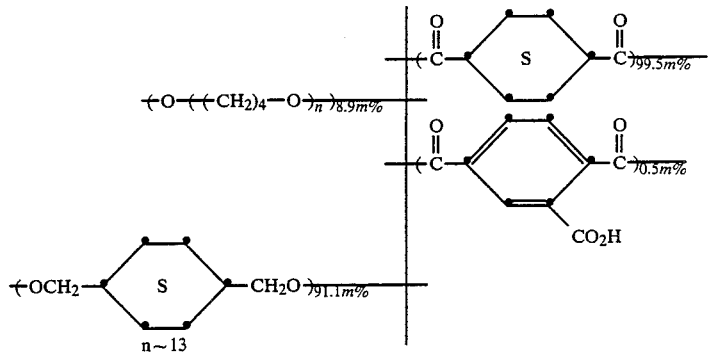

In a preferred embodiment of the invention, the thermoplastic binder is cellulose acetate propionate.

The amount of polymeric binder used in the slipping layer of the invention is not critical. In general the polymeric binder may be present in an amount of from about 0.1 to about 2 $g/m^2$.

Any dye can be used in the dye layer of the dye-donor element of the invention provided it is transferable to the dye-receiving layer by the action of heat. Especially good results have been obtained with sublimable dyes. Examples of sublimable dyes include anthraquinone dyes, e.g., Sumikalon Violet RS ® (product of Sumitomo Chemical Co., Ltd.), Dianix Fast Violet 3R-FS ® (product of Mitsubishi Chemical Industries, Ltd.), and Kayalon Polyol Brilliant Blue N-BGM ® and KST Black 146 ® (products of Nippon Kayaku Co., Ltd.); azo dyes such as Kayalon Polyol Brilliant Blue BM ®, Kayalon Polyol Dark Blue 2BM ®, and KST Black KR ® (products of Nippon Kayaku Co., Ltd.), Sumickaron Diazo Black 5G ® (product of Sumitomo Chemical Co., Ltd.), and Miktazol Black 5GH ® (product of Mitsui Toatsu Chemicals, Inc.); direct dyes such as Direct Dark Green B ® (product of Mitsubishi Chemical Industries, Ltd.) and Direct Brown M ® and Direct Fast Black D ® (products of Nippon Kayaku Co. Ltd.); acid dyes such as Kayanol Milling Cyanine 5R ® (product of Nippon Kayaku Co. Ltd.); basic dyes such as Sumicacryl Blue 6G ® (product of Sumitomo Chemical Co., Ltd.), and Aizen Malachite Green ® (product of Hodogaya Chemical Co., Ltd.);

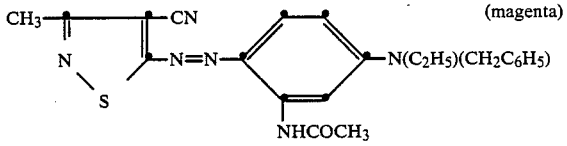

(magenta)

-continued

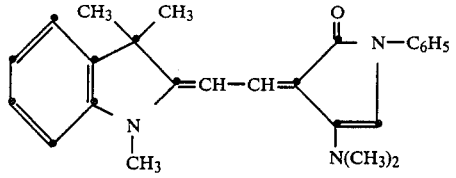

(yellow)

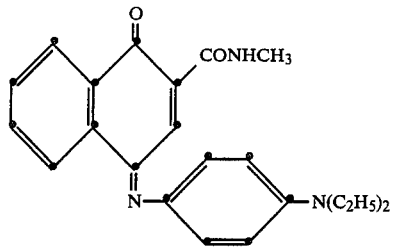

(cyan)

or any of the dyes disclosed in U.S. Pat. No. 4,541,830, the disclosure of which is hereby incorporated by reference. The above dyes may be employed singly or in combination to obtain a monochrome. The dyes may be used at a coverage of from about 0.05 to about 1 g/m$^2$ and are preferably hydrophobic.

A dye-barrier layer may be employed in the dye-donor elements of the invention to improve the density of the transferred dye. Such dye-barrier layer materials include hydrophilic materials such as those described and claimed in U.S. Pat. No. 4,716,144 by Vanier, Lum and Bowman.

The dye in the dye-donor element of the invention is dispersed in a polymeric binder such as a cellulose derivative, e.g., cellulose acetate hydrogen phthalate, cellulose acetate, cellulose acetate propionate, cellulose acetate butyrate, cellulose triacetate or any of the materials described in U.S. Pat. No. 4,700,207 of Vanier and Lum; a polycarbonate; poly(styrene-co-acrylonitrile), a poly(sulfone) or a poly(phenylene oxide). The binder may be used at a coverage of from about 0.1 to about 5 g/m$^2$.

The dye layer of the dye-donor element may be coated on the support or printed thereon by a printing technique such as a gravure process.

Any material can be used as the support for the dye-donor element of the invention provided it is dimensionally stable and can withstand the heat of the thermal printing heads. Such materials include polyesters such as poly(ethylene terephthalate); polyamides; polycarbonates; glassine paper; condenser paper; cellulose esters such as cellulose acetate; fluorine polymers such as polyvinylidene fluoride or poly(tetrafluoroethylene-co-hexafluoropropylene); polyethers such as polyoxymethylene; polyacetals; polyolefins such as polystyrene, polyethylene, polypropylene or methylpentane polymers; and polyimides such as polyimide-amides and polyetherimides. The support generally has a thickness of from about 2 to about 30 μm. It may also be coated with a subbing layer, if desired, such as those materials described in U.S. Pat. No. 4,695,288 of Ducharme or U.S. application Ser. No. 079,613 of Henzel, filed July 30, 1987.

The dye-receiving element that is used with the dye-donor element of the invention usually comprises a support having thereon a dye image-receiving layer. The support may be a transparent film such as a poly(ether sulfone), a polyimide, a cellulose ester such as cellulose acetate, a poly(vinyl alcohol-co-acetal) or a poly(ethylene terephthalate). The support for the dye-receiving element may also be reflective such as baryta-coated paper, polyethylene-coated paper, white polyester (polyester with white pigment incorporated therein), an ivory paper, a condenser paper or a synthetic paper such as duPont Tyvek®.

The dye image-receiving layer may comprise, for example, a polycarbonate, a polyurethane, a polyester, polyvinyl chloride, poly(styrene-co-acrylonitrile), poly(caprolactone) or mixtures thereof. The dye image-receiving layer may be present in any amount which is effective for the intended purpose. In general, good results have been obtained at a concentration of from about 1 to about 5 g/m$^2$.

As noted above, the dye-donor elements of the invention are used to form a dye transfer image. Such a process comprises imagewise-heating a dye-donor element as described above and transferring a dye image to a dye-receiving element to form the dye transfer image.

The dye-donor element of the invention may be used in sheet form or in a continuous roll or ribbon. If a continuous roll or ribbon is employed, it may have only one dye or may have alternating areas of other different dyes, such as sublimable cyan and/or magenta and/or yellow and/or black or other dyes. Such dyes are disclosed in U.S. Pat. Nos. 4,541,830; 4,698,651 of Moore, Weaver and Lum; 4,695,287 of Evans and Lum; and 4,701,439 of Weaver, Moore and Lum; and U.S. application Ser. Nos. 059,442 of Byers and Chapman, filed June 8, 1987; 059,443 of Evans and Weber, filed June 8, 1987; 095,796 of Evans and Weber, filed Sept. 14, 1987; and 123,441 of Byers, Chapman and McManus, filed Nov. 20, 1987, the disclosures of which are hereby incorporated by reference. Thus, one-, two-, three- or four-color elements (or higher numbers also) are included within the scope of the invention.

In a preferred embodiment of the invention, the dye-donor element comprises a poly(ethylene terephthalate) support coated with sequential repeating areas of yellow, cyan and magenta dye, and the above process steps are sequentially performed for each color to obtain a three-color dye transfer image. Of course, when the process is only performed for a single color, then a monochrome dye transfer image is obtained.

Thermal printing heads which can be used to transfer dye from the dye-donor elements of the invention are available commercially. There can be employed, for example, a Fujitsu Thermal Head (FTP-040 MCS001), a TDK Thermal Head F415 HH7-1089 or a Rohm Thermal Head KE 2008-F3.

A thermal dye transfer assemblage of the invention comprises (a) a dye-donor element as described above, and (b) a dye-receiving element as described above, the dye-receiving element being in a superposed relationship with the dye-donor element so that the dye layer of the donor element is in contact with the dye image-receiving layer of the receiving element.

The above assemblage comprising these two elements may be preassembled as an integral unit when a monochrome image is to be obtained. This may be done by temporarily adhering the two elements together at their margins. After transfer, the dye-receiving element is then peeled apart to reveal the dye transfer image.

When a three-color image is to be obtained, the above assemblage is formed on three occasions during the time when heat is applied by the thermal printing head. After the first dye is transferred, the elements are peeled apart. A second dye-donor element (or another area of the donor element with a different dye area) is then brought in register with the dye-receiving element and the process repeated. The third color is obtained in the same manner.

The following examples are provided to illustrate the invention.

EXAMPLE 1-FORCE MEASUREMENT TEST

A cyan dye-donor element was prepared by coating on a 6 μm poly(ethylene terephthalate) support:

(1) a subbing layer of a titanium alkoxide (duPont Tyzor TBT ®) (0.12 g/m$^2$) from a n-propyl acetate and n-butyl alcohol solvent mixture, and (2) a dye layer containing the cyan dye illustrated above (0.28 g/m$^2$) and duPont DLX-6000 Teflon ® micropowder (0.016 g/m$^2$), in a cellulose acetate propionate (2.5% acetyl, 45% propionyl) binder (0.44 g/m$^2$) coated from a toluene, methanol and cyclopentanone solvent mixture.

On the back side of the dye-donor was coated:

(1) a subbing layer of Bostik 7650 ® linear saturated polyester (Emhart Corp.) (0.09 g/m$^2$), and (2) a slipping layer of Petrarch Systems PS513 ® amino-terminated polysiloxane (identified above) in the amount given in Table 1, p-toluenesulfonic acid (2.5% of the wt. of the polysiloxane), BYK-320 ® (BYK Chemie, USA) copolymer of a polyalkylene oxide and a methyl alkylsiloxane (identified above) in the amount given in Table 1, in a cellulose acetate propionate binder (2.5% acetyl, 45% propionyl) (0.27 g/m$^2$) coated from a toluene and 3-pentanone solvent mixture.

A dye-receiving element was prepared by coating the following layers in the order recited on a titanium dioxide-pigmented polyethylene-overcoated paper stock which was subbed with a layer of poly(acrylonitrile-co-vinylidene chloride-co-acrylic acid) (14:79:7 wt. ratio) (0.08 g/m$^2$) coated from 2-butanone:

(1) Dye-receiving layer of Makrolon 5705 ® (Bayer AG Corporation) polycarbonate resin (2.9 g/m$^2$), Tone PCL-300 ® polycaprolactone (Union Carbide) (0.38 g/m$^2$), and 1,4-didecoxy-2,6-dimethoxyphenol (0.38 g/m$^2$) coated from methylene chloride; and (2) Overcoat layer of Tone PCL-300 ® polycaprolactone (Union Carbide) (0.11 g/m$^2$), FC-431 ® surfactant (3M Corp.) (0.016 g/m$^2$) and DC-510 ® surfactant (Dow Corning) (0.016 g/m$^2$) coated from methylene chloride.

The dye side of the dye-donor element strip approximately 10 cm × 13 cm in area was placed in contact with the dye image-receiving layer of the dye-receiver element of the same area. The assemblage was clamped to a stepper-motor driven 60 mm diameter rubber roller and a TDK Thermal Head (No. L-231) (thermostatted at 26° C.) was pressed with a force of 8.0 pounds (3.6 kg) against the dye-donor element side of the assemblage pushing it against the rubber roller.

The imaging electronics were activated causing the donor/receiver assemblage to be drawn between the printing head and roller at 6.9 mm/sec. Coincidentally, the resistive elements in the thermal print head were pulsed for 29 μsec/pulse at 128 μsec intervals during the 33 msec/dot printing time. A stepped density image was generated by incrementally increasing the number of pulses/dot from 0 to 255. The voltage supplied to the print head was approximately 23.5 volts, resulting in an instantaneous peak power of 1.3 watts/dot and a maximum total energy of 9.6 mjoules/dot.

As each "area test pattern" of given density was being generated, the force required for the pulling device to draw the assemblage between the print head and roller was measured using a Himmelstein Corp. 3-08TL (16-1) Torquemeter ® (10 inch-lb. range) and 6-205 Conditioning Module ®. Data were obtained at Steps 2 and 8, a moderate density and maximum density, as being most illustrative. The following results were obtained:

TABLE 1

| Slipping Layer | PS513 (g/m$^2$) | BYK-320 (g/m$^2$) | Relative Force (lbs) Step 2 | Relative Force (lbs) Step 8 |
|---|---|---|---|---|
| Comparison | 0 | 0.016 | 3.2 | 2.6 |
| Comparison | 0.016 | 0 | 2.2 | 2.5 |
| Invention | 0.008 | 0.008 | 2.0 | 1.9 |

The above results indicate that the use of a mixture of polysiloxanes gave results which are better than the use of either compound alone at the same equivalent weight.

EXAMPLE 2-USE OF PARTICLES

Example 1 was repeated except that MPP-620XF ® (Micro Powders Inc.) micronized polyethylene particles (PE) (0.054 g/m$^2$) or Fluo HT ® (Micro Powders Inc.) micronized polytetrafluoroethylene (PTFE) powder (0.054 g/m$^2$) were added to the slipping layer and the subbing layer was a titanium alkoxide (duPont Tyzor TBT ®) (0.12 g/m$^2$) coated from a n-propyl acetate and n-butyl alcohol solvent mixture. The processing was as in Example 1 with the following results:

TABLE 2

| Particles | PS513 (g/m$^2$) | BYK-320 (g/m$^2$) | Relative Force (lbs) Step 2 | Relative Force (lbs) Step 8 |
|---|---|---|---|---|
| PE (control) | 0 | 0 | >6.6 | >6.6 |
| PE (comparison) | 0 | 0.016 | 1.1 | 1.0 |
| PE (comparison) | 0.016 | 0 | 1.0 | 0.9 |
| Invention | 0.008 | 0.008 | 0.9 | 0.85 |
| Invention | 0.008 | 0.016 | 0.8 | 0.8 |
| Invention | 0.016 | 0.008 | 0.8 | 0.8 |
| PTFE (control) | 0 | 0 | 1.8 | 3.5 |
| PTFE (comparison) | 0 | 0.016 | 1.1 | 1.3 |
| PTFE (comparison) | 0.016 | 0 | 0.9 | 1.3 |
| Invention | 0.008 | 0.008 | 1.0 | 1.1 |
| Invention | 0.008 | 0.016 | 0.9 | 0.9 |
| Invention | 0.016 | 0.008 | 0.9 | 1.0 |

The above results indicate that the addition of organic lubricating particles to the mixture of polysiloxanes gave a further improvement in reducing the relative force which is better than the use of either polysiloxane compound alone at the same equivalent weight.

EXAMPLE 3-COMPARATIVE EXAMPLE

A cyan dye-donor was prepared using a slipping layer of a silicone oil and silicone surfactant from EPA 138,483 described above. It was prepared by coating on a 6 μm poly(ethylene terephthalate) support:

(1) a subbing layer of a titanium alkoxide (duPont Tyzor TBT ®) (0.12 g/m$^2$) from a n-propyl acetate and n-butyl alcohol solvent mixture, and (2) a dye layer containing the cyan dye illustrated above (0.28 g/m$^2$) and duPont DLX-6000 Teflon® micropowder (0.016 g/m$^2$), in a cellulose acetate propionate (2.5% acetyl, 45% propionyl) binder (0.44 g/m$^2$) coated from a toluene, methanol and cyclopentanone solvent mixture.

On the back side of the dye-donor was coated:

(1) a subbing layer of a titanium alkoxide (duPont Tyzor TBT®) (0.12 g/m$^2$) from a n-propyl acetate and n-butyl alcohol solvent mixture, and (2) a slipping layer of:

(a) Petrarch Systems PS045® trimethylsiloxy-terminated polydimethylsiloxane (silicone oil) (molecular weight of 63,000 viscosity 10,000 cps) in the amount given in Table 3, (b) Union Carbide L-7500® organo-silicone surfactant in the amount given in Table 3, (c) particles of either MPP-620XF® (Micro Powders Inc.) micronized polyethylene particles (PE) (0.054 g/m$^2$), Fluo HT® (Micro Powders Inc.) micronized polytetrafluoroethylene (PTFE) powder (0.054 g/m$^2$), or Zeothix 177® (J. M. Huber Co.) precipitated silica (0.054 g/m$^2$) having an average particle size of 1.5 μm, and (d) a cellulose acetate propionate binder (2.5% acetyl, 45% priopionyl) (0.27 g/m$^2$) coated from a toluene and 3-pentanone solvent mixture.

A dye-receiving element was prepared as in Example 1 and testing was done as in Example 1 with the following results:

TABLE 3

| Particles | Silicone Oil (g/m$^2$) | Silicone Surfactant (g/m$^2$) | Relative Force (lbs) Step 2 | Relative Force (lbs) Step 8 |
|---|---|---|---|---|
| PE (comparison) | 0.0013 | 0.0068 | 1.4 | 3.9 |
| PE (comparison) | 0.0027 | 0.014 | 1.5 | 3.1 |
| PTFE (comparison) | 0.0013 | 0.0068 | >6.6 | >6.6 |
| PTFE (comparison) | 0.0027 | 0.014 | 1.4 | 5.4 |
| Silica (comparison) | 0.0013 | 0.0068 | 3.0 | >6.6 |
| Silica (comparison) | 0.0027 | 0.014 | 2.5 | 3.9 |

The above results indicate that all of the slipping layers of this prior art patent had force measurements higher than the 0.8 to 1.1 lbs force as described in Example 2 above for the slipping layer of the invention.

The invention has been described in detail with particular reference to preferred embodiments thereof, but it will be understood that variations and modifications can be effected within the spirit and scope of the invention.

What is claimed is:

1. In a dye-donor element for thermal dye transfer comprising a support having on one side thereof a dye layer and on the other side a slipping layer comprising a lubricating material in a polymeric binder, said lubricating material comprising a linear or branched aminoalkyl-terminated poly(dialkyl, diaryl or alkylaryl siloxane), the improvement wherein said slipping layer also comprises another polysiloxane, other than said aminoalkyl-terminated polysiloxane, comprising a copolymer of a polyalkylene oxide and a methyl alkylsiloxane wherein said alkyl group has more than one carbon atom.

2. The element of claim 1 wherein said alkyl group of said alkylsiloxane has about 8 carbon atoms and said polyalkylene is polypropylene.

3. The element of claim 1 wherein each polysiloxane independently is present in an amount of from about 0.0005 to about 0.03 g/m$^2$, representing approximately 0.2 to 12% of the binder weight, and the polymeric binder is present in an amount of about 10 to about 99.5% of the total layer coverage.

4. The element of claim 1 wherein said slipping layer also has dispersed therein organic lubricating particles.

5. The element of claim 1 wherein said polymeric binder is cellulose acetate propionate.

6. The element of claim 1 wherein said aminoalkyl-terminated siloxane is an aminopropyldimethyl-terminated polydimethylsiloxane.

7. The element of claim 6 wherein said aminopropyldimethyl-terminated polydimethylsiloxane has the formula:

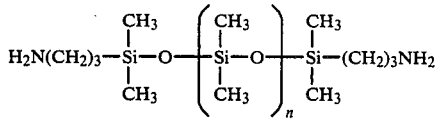

wherein n is from about 10 to about 2000.

8. The element of claim 1 wherein said aminoalkyl-terminated siloxane is a T-structure polydimethylsiloxane with an aminoalkyl functionality at the branchpoint.

9. The element of claim 8 wherein said aminoalkyl-terminated siloxane has the formula:

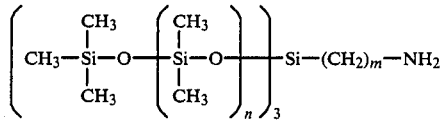

wherein m is from about 1 to about 10 and n is from about 10 to about 1000.

10. In a process of forming a dye transfer image comprising (a) imagewise-heating a dye-donor element comprising a support having on one side thereof a dye layer and on the other side a slipping layer comprising a lubricating material in a polymeric binder, said lubricating material comprising a linear or branched aminoalkyl-terminated poly(dialkyl, diaryl or alkylaryl siloxane), and (b) transferring a dye image to a dye-receiving element to form said dye transfer image, the improvement wherein said slipping layer also comprises another polysiloxane, other than said aminoalkyl-terminated polysiloxane, comprising a copolymer of a polyalkylene oxide and a methyl alkylsiloxane wherein said alkyl group has more than one carbon atom.

11. The process of claim 10 wherein said alkyl group of said alkylsiloxane has about 8 carbon atoms and said polyalkylene is polypropylene.

12. The process of claim 10 wherein each polysiloxane independently is present in an amount of from about 0.0005 to about 0.03 g/m$^2$, representing approximately 0.2 to 12% of the binder weight, and the polymeric binder is present in an amount of about 10 to about 99.5% of the total layer coverage.

13. The process of claim 10 wherein said aminoalkyl-terminated polysiloxane is an aminopropyldimethyl-terminated polydimethylsiloxane or a T-structure polydimethylsiloxane with an aminoalkyl functionality at the branchpoint.

14. The process of claim 10 wherein said support is poly(ethylene terephthalate) which is coated with sequential repeating areas of cyan, magenta and yellow dye, and said process steps are sequentially performed for each color to obtain a three-color dye transfer image.

15. In a thermal dye transfer assemblage comprising:

(a) a dye-donor element comprising a support having on one side thereof a dye layer and on the other side a slipping layer comprising a lubricating material in a polymeric binder, said lubricating material comprising a linear or branched aminoalkyl-terminated poly(dialkyl, diaryl or alkylaryl siloxane), and (b) a dye-receiving element comprising a support having thereon a dye image-receiving layer, said dye-receiving element being in a superposed relationship with said dye-donor element so that said dye layer is in contact with said dye image-receiving layer, the improvement wherein said slipping layer also comprises another polysiloxane, other than said aminoalkyl-terminated polysiloxane, comprising a copolymer of a polyalkylene oxide and a methyl alkylsiloxane wherein said alkyl group has more than one carbon atom.

16. The assemblage of claim 15 wherein said alkyl group of said alkylsiloxane has about 8 carbon atoms and said polyalkylene is polypropylene.

17. The assemblage of claim 15 wherein each polysiloxane independently is present in an amount of from about 0.0005 to about 0.03 $g/m^2$, representing approximately 0.2 to 12% of the binder weight, and the polymeric binder is present in an amount of about 10 to about 99.5% of the total layer coverage.

18. The assemblage of claim 15 wherein said slipping layer also has dispersed therein organic lubricating particles.

19. The assemblage of claim 15 wherein said polymeric binder is cellulose acetate propionate.

20. The assemblage of claim 15 wherein said aminoalkyl-terminated polysiloxane is an aminopropyldimethyl-terminated polydimethylsiloxane or a T-structure polydimethylsiloxane with an aminoalkyl functionality at the branchpoint.

* * * * *